US006439548B2

(12) United States Patent
Masunaga

(10) Patent No.: US 6,439,548 B2
(45) Date of Patent: Aug. 27, 2002

(54) OVERFLOW DEVICE FOR CARBURETOR

(75) Inventor: Akinobu Masunaga, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/749,040

(22) Filed: Dec. 28, 2000

(30) Foreign Application Priority Data

Dec. 28, 1999 (JP) ..... 11-372989

(51) Int. Cl.[7] ..... F02M 5/12
(52) U.S. Cl. ..... 261/70; 261/72.1; 261/DIG. 67
(58) Field of Search ..... 261/66, 70, 72.1, 261/DIG. 50, DIG. 67

(56) References Cited

U.S. PATENT DOCUMENTS 1,357,877 A * 11/1920 Kraus ..... 261/70 X
1,746,619 A * 2/1930 Stanco ..... 261/70 X
3,031,172 A * 4/1962 Rapplean ..... 261/DIG. 50
3,695,590 A * 10/1972 Nishihara ..... 261/72.1 X
3,825,238 A * 7/1974 Nishihara et al. ..... 261/66 X
4,350,124 A * 9/1982 Kitano et al. ..... 261/DIG. 67

FOREIGN PATENT DOCUMENTS

JP 61-138866 * 6/1986
JP 10-159655 A 6/1998

* cited by examiner

*Primary Examiner*—Richard L. Chiesa
(74) *Attorney, Agent, or Firm*—Birch, Stewart, Kolasch & Birch, LLP

(57) ABSTRACT

To provide an overflow device for suppressing undue emission of fuel from an overflow pipe which can be produced with a simple structure at a low cost, and can be simply applied also to any existing carburetors. An overflow device for a float type carburetor includes an overflow pipe having an upper end opening exposed to a space in a float chamber defined above a constant fuel level in the float chamber, and a shield member arranged above the constant fuel level for forming a shielded space in the vicinity of the upper end opening. The shield member has a side wall vertically extending above and below the upper end opening, a top wall positioned above the upper end opening, and a bottom wall positioned below the upper end opening. The bottom wall is formed with fuel holes for allowing the fuel to flow into and out of the shielded space. The side wall is formed with small vent holes capable of suppressing the entry of the fuel into the shielded space.

20 Claims, 8 Drawing Sheets

OVERFLOW DEVICE FOR CARBURETOR

BACKGROUND OF THE INVENTION

1. Field of the Invention

The present invention relates to an overflow device for a carburetor having a float chamber and a float provided in the float chamber wherein a constant fuel level in the float chamber is formed by the float.

2. Description of Background Art

In a float type carburetor mounted on an internal combustion engine, the amount of fuel supplied from a fuel tank and flowing into a float chamber is adjusted by a float valve operated in concert with vertical movements of a float floating in the fuel stored in the float chamber, thereby maintaining a fuel level in the float chamber at a constant level. As a result, a proper amount of fuel is drawn from a nozzle by a vacuum produced in an intake passage, and is mixed with air passing through the intake passage, thereby forming a fuel mixture having a proper air-fuel ratio.

However, if the float valve is not tightly closed because of foreign matter lodged between the float valve and a valve seat in such a float type carburetor, for example, the fuel is excessively supplied into the float chamber beyond the constant fuel level, so that a fuel mixture having a proper air-fuel ratio is not formed thus causing a poor operating condition for the internal combustion engine. Such an excess rise in fuel level is prevented by providing an overflow pipe having one end opening to a fuel level forming position higher than the constant fuel level by a given value and the other end communicating with the outside of the float chamber to discharge the excess fuel above the fuel level forming position through the overflow pipe to the outside of the float chamber.

Normally, the upper end opening of the overflow pipe is open above the constant fuel level in the float chamber. Accordingly, when fuel in the float chamber forms waves because of fluctuations of a vehicle body as of a motorcycle whose vehicle body fluctuates largely or because of vibrations of the internal combustion engine, a part of the fuel may rise up to the upper end opening of the overflow pipe directly or indirectly as by rebounding of the fuel on the wall of the float chamber and may flow out of the float chamber through the overflow pipe, causing environmental pollution or poor fuel economy in some cases. Various techniques have been proposed to suppress such undue emission of the fuel from the overflow pipe.

In an overflow device for a carburetor disclosed in Japanese Patent Laid-open No. 10-159655, for example, a cage type valve storing member is fixed to an upper end portion of an overflow pipe, and a vertically movable valve is inserted in the valve storing member so as to float on the surface of fuel in a float chamber. When the fuel level is lower than an overflow level, the valve comes into close contact with a fuel inlet of the overflow pipe to close the fuel inlet, whereas when the fuel level reaches the overflow level, the valve floats on the fuel surface to open the fuel inlet. Even when the fuel in the float chamber forms a wave, the fuel inlet of the overflow pipe is not opened so far as the valve does not float on the fuel surface. Accordingly, it is considered that fuel emission from the overflow pipe due to causing waves in the fuel may be suppressed.

However, the conventional overflow device disclosed in the above publication has a complicated and costly structure because the valve storing member and the valve are provided at the upper end portion of the overflow pipe. Further, the fuel inlet of the overflow pipe serving also as a valve seat for the valve is required to have a shape for making the fuel inlet to be tightly closed by the valve. Accordingly, it is difficult to apply this overflow device directly to a carburetor having an existing overflow pipe.

SUMMARY AND OBJECTS OF THE INVENTION

It is accordingly an object of the present invention to provide an overflow device for suppressing undue emission of fuel from an overflow pipe which can be produced with a simple structure at a low cost, and can be simply applied also to any existing carburetors.

In accordance with the present invention, there is provided in a carburetor having a float chamber and a float provided in said float chamber wherein the amount of fuel flowing into said float chamber is adjusted according to behavior of said float to thereby form a constant fuel level in said float chamber. An overflow device includes an overflow pipe having an upper end opening exposed to a space in said float chamber defined above said constant fuel level. A shield member is arranged above said constant fuel level and includes a side wall extending along an upper end portion of said overflow pipe between an upper position above said upper end opening and a lower position below said upper end opening so as to define a shielded space around said upper end opening. The shielded space is kept in communication with said space in said float chamber through a fuel opening for allowing the fuel to flow into and out of said shielded space and a vent opening is capable of suppressing the entry of the fuel into said shielded space. The fuel opening and the vent opening are formed by providing the shield member. The fuel opening is positioned only below the upper end opening. At least a part of the vent opening is positioned above the upper end opening.

According to the present invention, the shield member arranged above the constant fuel level has a side wall for defining the shielded space around the upper end opening. That is, the overflow device can be configured without any movable portions, i.e., with a simple structure at a low cost. Furthermore, the shield member can be simply applied to any existing overflow pipes. Even when the fuel in the float chamber causes a wave, the entry of the fuel from the vent opening positioned above the upper end opening of the overflow pipe into the shielded space can be suppressed, and the discharge of the fuel from the upper end opening can further be reduced owing to the presence of the shielded space. As a result, undue emission of the fuel through the overflow pipe to the outside of the float chamber can be suppressed.

Owing to the presence of the vent opening, the rise of the fuel level in the shielded space in the case of overflowing can be smoothly effected without a possibility that the pressure in the shielded space may be increased by the fuel flowing into the shielded space to hinder the rise of the fuel level in the shielded space. Accordingly, the rising speed of the fuel level inside the shielded space can be made substantially equal to that of the fuel level outside the shielded space. As a result, there is no possibility that the rising speed of the fuel level inside the shielded space may become lower than that of the fuel level outside the shielded space because of an increase in pressure inside the shielded space, so that it is possible to prevent an excess fuel from being supplied to the intake passage of the carburetor and to discharge the excess fuel through the overflow pipe to the outside of the float chamber at a preset overflow level.

In accordance with the present invention, the shield member further has a top wall positioned above the upper end opening and a bottom wall positioned below the upper end opening, the top wall and the bottom wall being contiguous to the side wall; the fuel opening is a hole formed through the bottom wall; and the vent opening is a hole formed through the side wall.

The shield member is a case member composed of the side wall, the top wall, and the bottom wall. Further, the fuel opening is a hole formed through the bottom wall, and the vent opening is a hole formed through the side wall. Accordingly, not only the entry of the fuel from the vent opening into the shielded space due to causing waves in the fuel, but also the entry of the fuel from the fuel opening into the shielded space due to causing waves in the fuel can be greatly suppressed.

In accordance with the present invention, the overflow device further includes an interfering member provided in the shielded space between the upper end opening and the vent opening in opposed relationship with the vent opening.

Even when the fuel enters the shielded space from the vent opening because of causing waves in the fuel level in the float chamber, the fuel having entered comes into collision with the interfering member interposed between the upper end opening of the overflow pipe and the vent opening so as to face the vent opening, so that the fuel having entered is hindered from advancing toward the upper end opening. Thus, the fuel reaching the upper end opening can be greatly reduced in amount, and the discharge of the fuel from the overflow pipe because of causing waves in the fuel level can therefore be further suppressed.

In accordance with the present invention, in the overflow device for the carburetor, the side wall is provided spirally about the upper end opening so as to extend along the upper end portion of the overflow pipe; and the vent opening is formed by an outer end of an outermost side wall portion positioned radially outermost of the side wall and an inner side wall portion positioned radially inside of the outermost side wall portion.

Even when the fuel enters the shielded space from the vent opening, most of the fuel having entered comes into collision with the inner wall surface of the outermost side wall portion and the outer wall surface of the inner side wall portion, and is therefore hindered from advancing towards the upper end opening of the overflow pipe. Accordingly, the fuel reaching the upper end opening can be greatly reduced in amount, and the discharge of the fuel from the overflow pipe because of causing waves in the fuel level can therefore be further suppressed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Some preferred embodiments of the present invention will now be described with reference to the attached drawings FIGS. 1 to 8.

Figure 1:
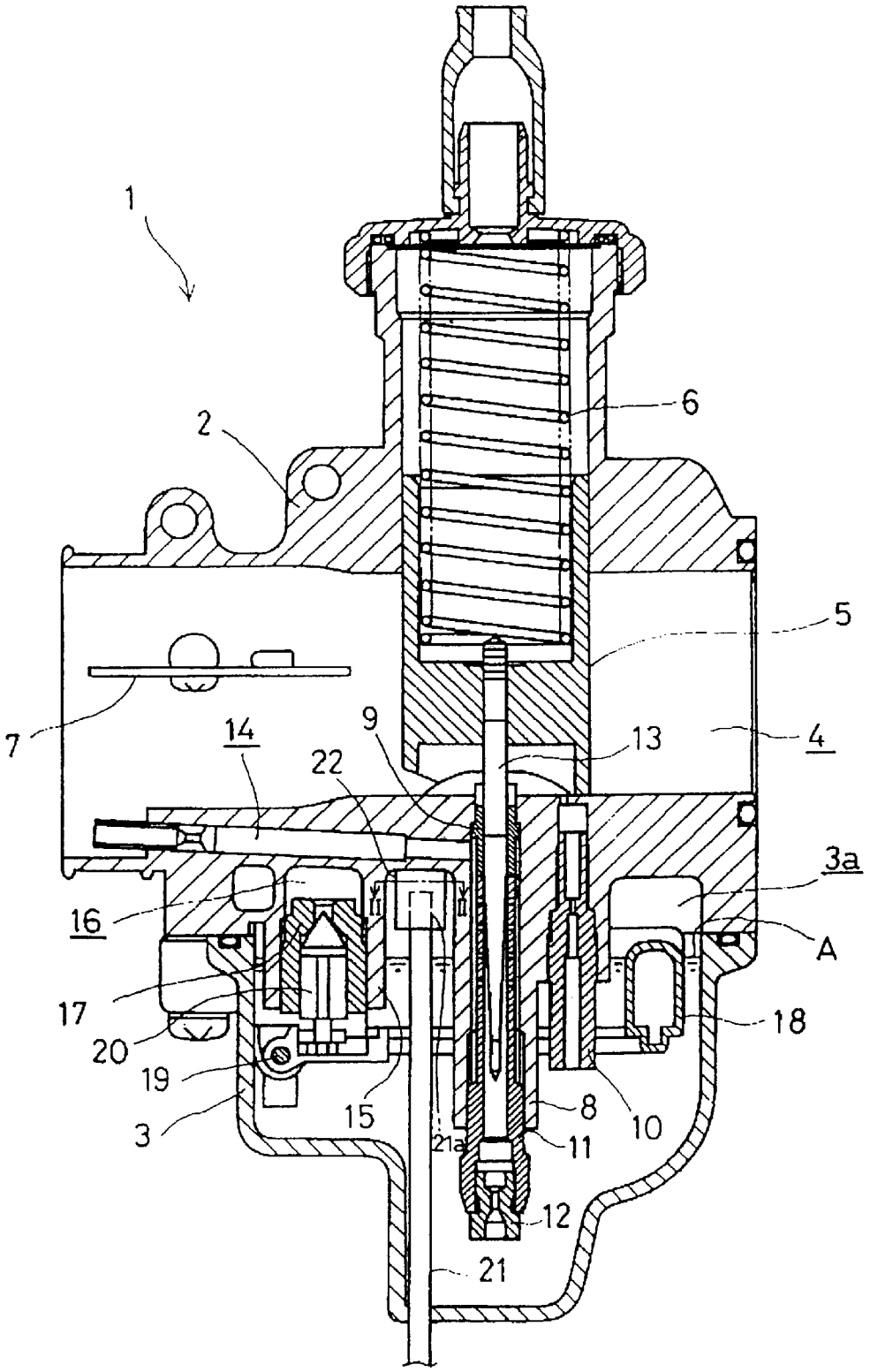
FIG. 1 is a vertical sectional view of a carburetor including an overflow device according to a first preferred embodiment of the present invention.

A first preferred embodiment of the present invention will now be described with reference to FIGS. 1 to 3. Referring to FIG. 1, a carburetor 1 is mounted on an internal combustion engine for a motorcycle. The carburetor 1 includes a carburetor body 2 and a float chamber 3 attached to a lower portion of the carburetor body 2. The carburetor body 2 is formed with an intake passage 4 and provided with a piston type throttle valve 5 retained so as to be movable across the intake passage 4 in a vertical direction substantially perpendicular thereto. The throttle valve 5 is biased by a compression coil spring 6 in a direction of closing the intake passage 4. The throttle valve 5 is operatively connected through a wire (not shown) to a throttle grip (not shown). Accordingly, the throttle valve 5 is raised or lowered across the intake passage 4 according to the operation of the throttle grip, thereby adjusting the amount of air flowing in the intake passage 4. A choke valve 7 is fixed upstream of the throttle valve 5 in the intake passage 4.

The carburetor body 2 is formed with a cylindrical projecting portion 8 extending into the float chamber 3. The projecting portion 8 is provided with a needle jet 9 and a slow jet 10. The needle jet 9 is held in the projecting portion 8 by a holder 11 threadedly engaged with the projecting portion 8. A main jet 12 is fixed to the lower end of the holder 11. A jet needle 13 is mounted at its upper end portion to a bottom wall of the throttle valve 5, and is inserted in the needle jet 9 so that a gap between the needle jet 9 and the jet needle 13 is changed according to the movement of the throttle valve 5. Accordingly, fuel in an amount changing with changes in opening degree of the throttle valve 5 is supplied to a venturi portion formed between the throttle valve 5 and the wall of the intake passage 4. A bleed air passage 14 is provided for supplying air to a plurality of bleed holes formed through the wall of the holder 11 and also serves as an air bleed pipe.

The carburetor body 2 is further formed with a cylindrical projecting portion 15 extending into the float chamber 3 at a position spaced from the projecting portion 8 and near the peripheral edge of the float chamber 3. A fuel induction passage 16 communicating with a fuel tank (not shown) is formed inside the projecting portion 15, and a valve seat 17 on which a float valve 20 to be hereinafter described is adapted to rest is fixed downstream of the fuel induction passage 16 in the projecting portion 15.

A float 18 is provided in the float chamber 3, and a float pin 19 is fixed to a pair of support arms (not shown) provided on the carburetor body 2. The float 18 is pivotably supported to the float pin 19 so as to swing according to a varying fuel level in the float chamber 3. A float valve 20 for adjusting the amount of fuel to be supplied from the fuel induction passage 16 into the float chamber 3 is mounted on the float 18 so as to be operated in concert with the float 18 in such a manner that the float valve 20 comes into abutment against or separation from the valve seat 17.

Accordingly, when the fuel level in the float chamber 3 lowers, the float 18 swings downwardly and the float valve 20 is therefore opened to allow the fuel to flow into the float chamber 3. When the fuel level in the float chamber 3 rises with an increase in the amount of fuel flowing into the float chamber 3, the float 18 swings upward and the float valve 20 therefore comes into close contact with the valve seat 17. That is, the float valve 20 is closed to stop the flowing of the fuel into the float chamber 3, thus forming a predetermined constant fuel level A in the float chamber 3.

An overflow pipe 21 is provided between the projecting portions 8 and 15 in the float chamber 3 so as to vertically extend through a bottom wall of the float chamber 3. The overflow pipe 21 has an upper end portion 21*a* formed with an upper end opening 21*b*. The upper end opening 21*b* is positioned in a space 3*a* defined above the constant fuel level A. Although not especially shown, the overflow pipe 21 has a lower end portion opening outside of the float chamber 3 and connected to the fuel tank, for example. The height from the constant fuel level A to the upper end opening 21*b* is set to a value such that it is possible to prevent an excess fuel amount from being supplied from the needle jet 9 or the slow jet 10 into the venturi portion, causing a poor operating condition of the internal combustion engine.

Figure 3:
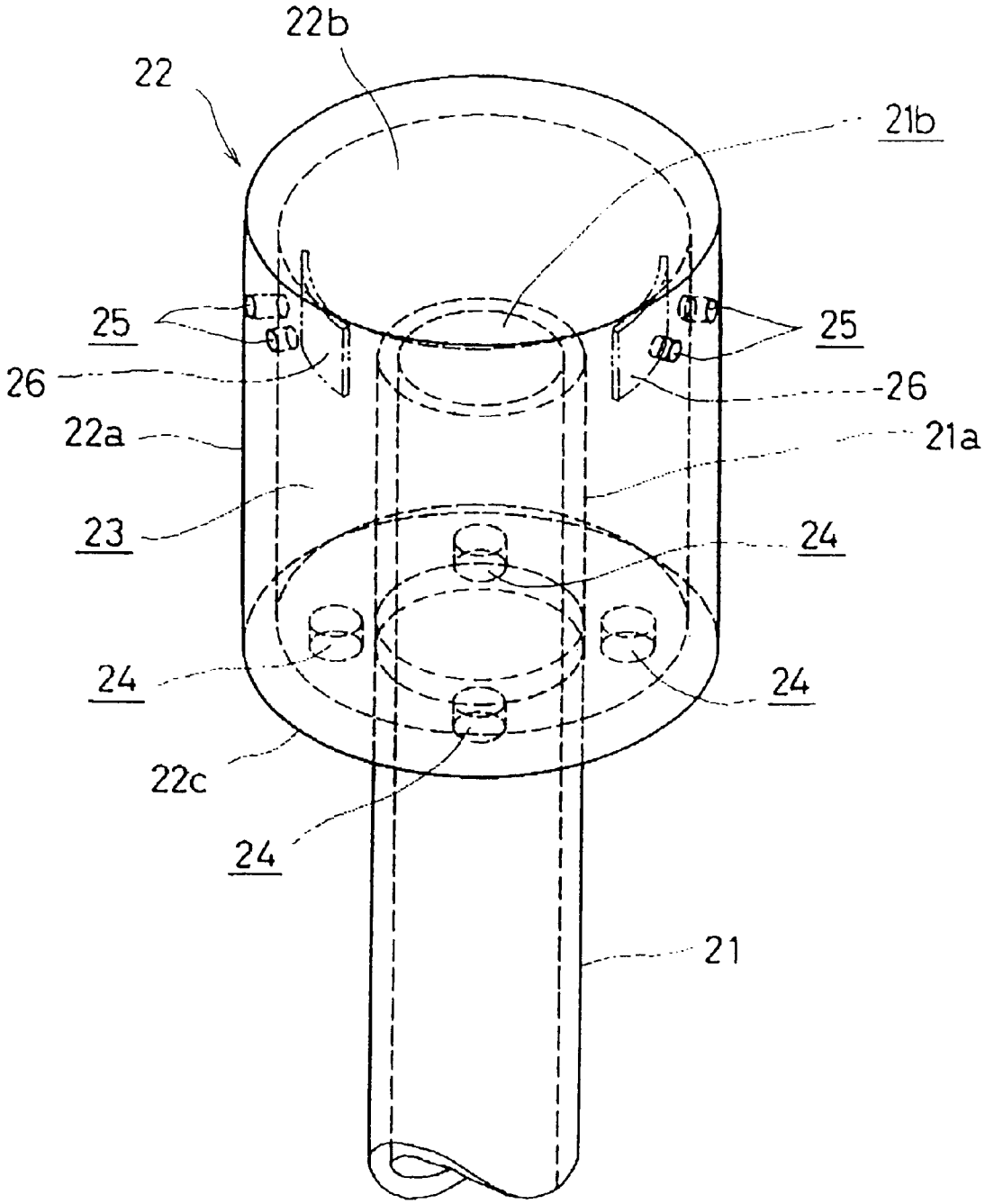
FIG. 3 is a perspective view of an essential part of the overflow device.

As shown in FIGS. 1 and 3, a cylindrical shield member 22 as a member independent of the carburetor body 2 is mounted on the carburetor body 2 by fixing means such as welding at a position between the projecting portions 8 and 15. The shield member 22 is positioned above the constant fuel level A in such a manner as to surround the upper end portion 21*a* of the overflow pipe 21 and be spaced from the upper end opening 21*b* in upward, downward, and sideward directions, thereby defining a shielded space 23 shielded from the space 3*a* in the float chamber 3 around the upper end opening 21*b*. The overflow pipe 21 and the shield member 22 constitute an overflow device. The sideward direction mentioned above means a direction perpendicular to the vertical direction.

Figure 2:
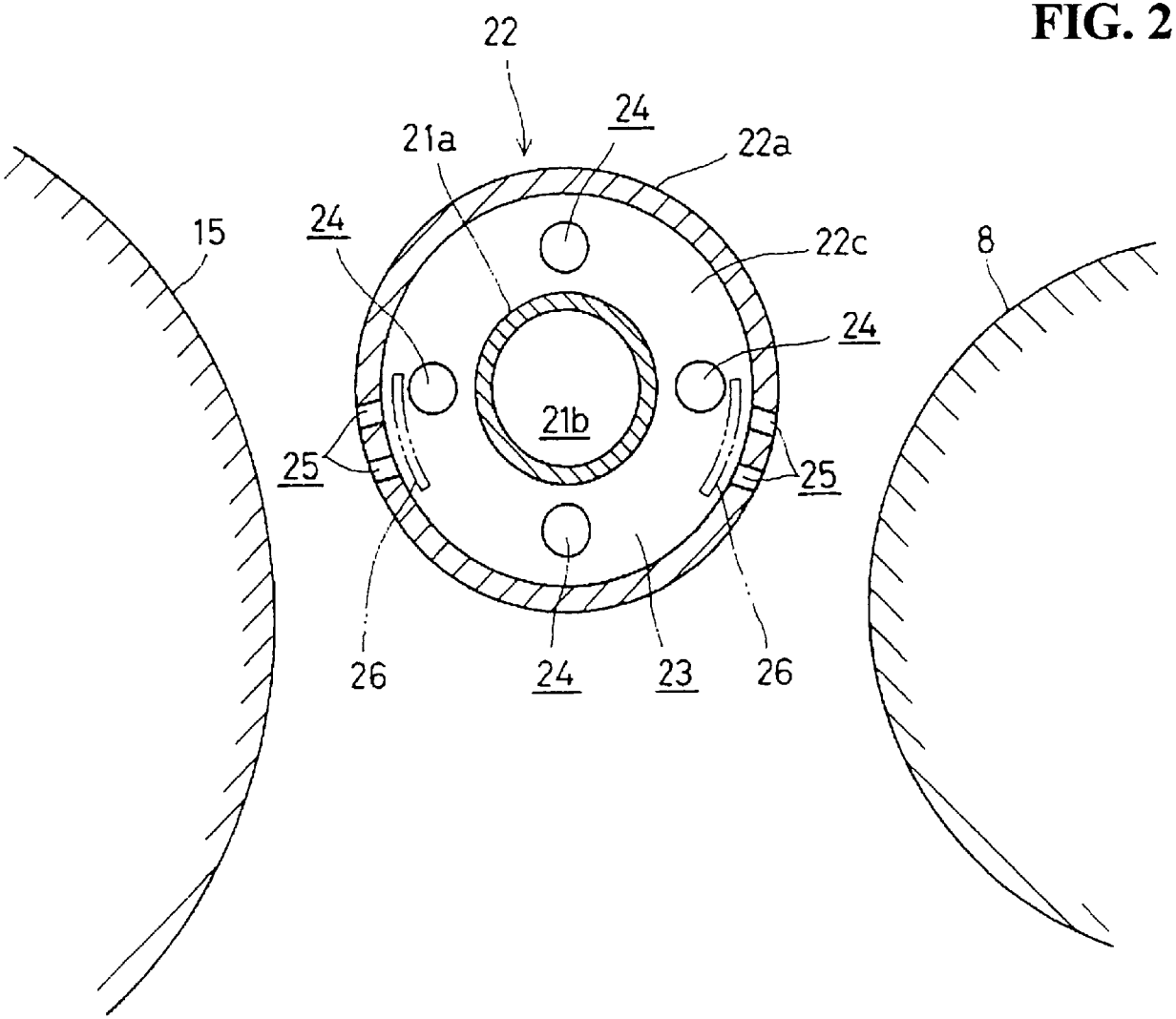
FIG. 2 is a cross section taken along the line II—II in FIG. 1.

As shown in FIGS. 2 and 3, the shield member 22 has a side wall 22*a*, a top wall 22*b* contiguous to the upper edge of the side wall 22*a*, and a bottom wall 22*c* contiguous to the lower edge of the side wall 22*a*. The side wall 22*a* is spaced from the upper end portion 21*a* in the sideward direction and vertically extends above and below the upper end opening 21*b*. The top wall 22*b* is fixed to the carburetor body 2 and is spaced from the upper end opening 21*b* in the upward direction. The bottom wall 22*c* is spaced from the upper end opening 21*b* in the downward direction and has an insert hole having a diameter substantially equal to the outer diameter of the overflow pipe 21. The insert hole is formed at a substantially central portion of the bottom wall 22*c*, and the overflow pipe 21 is fitted with the insert hole of the bottom wall 22*c*.

The bottom wall 22*c* is further formed with a plurality of (e.g., four) fuel holes 24 circumferentially spaced from each other as a fuel opening. In the case of overflowing such that the fuel level in the float chamber 3 may rise from the constant fuel level A to reach the position of the upper end opening 21*b*, i.e., an overflow level, the fuel holes 24 allow the fuel in the float chamber 3 to flow into the shielded space 23 and also allow the fuel in the shielded space 23 to flow out of the shielded space 23. The fuel holes 24 are positioned only below the upper end opening 21*b*.

The size of each fuel hole 24 is set so as to obtain a fuel flow through all the fuel holes 24 to such an extent that the rising speed of the fuel level inside the shielded space 23 in the case of overflowing is made substantially equal to that of the fuel level outside the shielded space 23 in cooperation with small vent holes 25 to be hereinafter described. Accordingly, the fuel in the shielded space 23 can also be made to smoothly flow back through the fuel holes 24 into the float chamber 3.

On the other hand, the side wall 22*a* is formed with a plurality of (e.g., four) small vent holes 25 as a vent opening for making communication between the space 3*a* and the shielded space 23. The vent holes 25 are positioned above and to the side of the upper end opening 21*b*. In this preferred embodiment, the four vent holes 25 are composed of two sets of vent holes circumferentially spaced from each other, one of the two sets being opposed to the projecting portion 8 and the other being opposed to the projecting portion 15. The size of each vent hole 25 is set so as not to hinder a smooth rise of the fuel level in the shielded space 23 by the fuel flowing through the fuel holes 24 in the case of overflowing and further to suppress the entry of the fuel through the vent holes 25 into the shielded space 23 due to causing waves in the fuel in the float chamber 3. The top wall 22*b* has no holes.

Accordingly, when the fuel in the float chamber 3 has the constant fuel level A, the overflow pipe 21 is always kept in communication with the space 3*a* in the float chamber 3 through the shielded space 23 by only the fuel holes 24 and the vent holes 25 (any possible very small gaps such as a very small gap possibly produced between the insert hole of the bottom wall 22*c* and the overflow pipe 21 fitted with the insert hole may be considered to be negligible). On the other hand, in the case of overflowing, the fuel in the float chamber 3 can be discharged from the float chamber 3 through the shielded space 23.

In the case that the fuel level in the float chamber 3 is inclined to such an extent that it temporarily becomes a position above the upper end opening 21*b* during slope running, acceleration, deceleration, or turning of the motorcycle, and that all the four fuel holes 24 are not positioned below the inclined fuel level, the rising speed of the fuel level inside the shielded space 23 becomes lower than that of the fuel level outside the shielded space 23, thereby suppressing the discharge of the fuel having the inclined fuel level from the upper end opening 21*b*. In particular, by arranging the overflow pipe 21 in the vicinity of the center position of the float chamber 3, the discharge of the fuel having the inclined fuel level from the upper end opening 21*b* can be further suppressed.

The operation of the first preferred embodiment mentioned above will now be described.

The shield member 22 mounted on the carburetor body 2 and positioned above the constant fuel level A in the float chamber 3 has the side wall 22*a* vertically extending above and below the upper end opening 21*b* of the overflow pipe 21 to define the shielded space 23 around the upper end opening 21*b*. Thus, the overflow device composed of the overflow pipe 21 and the shield member 22 can be configured without any movable portions, i.e., with a simple structure at a low cost. Furthermore, the shield member 22 can be simply applied to any existing overflow pipes.

Further, even when the fuel in the float chamber 3 causes waves because of fluctuations of a vehicle body of the motorcycle, vibrations of the internal combustion engine, etc., the entry of the fuel from the vent holes 25 positioned above the upper end opening 21*b* of the overflow pipe 21 into the shielded space 23 can be suppressed, and the discharge of the fuel from the upper end opening 21*b* can further be reduced owing to the presence of the shielded space 23. As a result, undue emission of the fuel through the overflow pipe 21 to the outside of the float chamber 3 can be suppressed. Further, the fuel having entered the shielded space 23 through the fuel holes 24 because of causing waves in the fuel can be smoothly returned through the fuel holes 24 into the float chamber 3.

Owing to the presence of the vent holes 25, the rise of the fuel level in the shielded space 23 in the case of overflowing can be smoothly effected without a possibility that the pressure in the shielded space 23 may be increased by the fuel flowing into the shielded space 23 to hinder the rise of the fuel level in the shielded space 23. Accordingly, the rising speed of the fuel level inside the shielded space 23 can be made substantially equal to that of the fuel level outside the shielded space 23, i.e., the fuel level in the float chamber 3. As a result, there is no possibility that the rising speed of the fuel level inside the shielded space 23 may become lower than that of the fuel level outside the shielded space 23 because of an increase in pressure inside the shielded space 23, so that it is possible to prevent an excess fuel from being supplied to the intake passage 4 of the carburetor 1 and to discharge the excess fuel through the overflow pipe 21 to the outside of the float chamber 3 at the preset overflow level.

The vent holes 25 can be formed at arbitrary positions on the side wall 22*a* of the shield member 22. That is, the degree of freedom of the arrangement of the vent holes 25 is large. Accordingly, by arranging the vent holes 25 at the positions opposed to the projecting portions 8 and 15 formed in the vicinity of the side wall 22*a* in the float chamber 3, it is difficult for the waves of the fuel in the float chamber 3 to enter the shielded space 23 through the vent holes 25. As a result, undue emission of the fuel through the overflow pipe 21 to the outside of the float chamber 3 can be further suppressed.

The shield member 22 is a cylindrical case member composed of the side wall 22*a*, the top wall 22*b*, and the bottom wall 22*c*. Further, the vent holes 25 are formed through the side wall 22*a*, and the fuel holes 24 are formed through the bottom wall 22*c*. Accordingly, not only the entry of the waves of fuel from the vent holes 25 into the shielded space 23, but also the entry of the waves of fuel from the fuel holes 24 into the shielded space 23 can be greatly suppressed.

A second preferred embodiment of the present invention will now be described with reference to FIGS. 2 and 3. The second preferred embodiment has the same configuration as that of the first preferred embodiment except for the shield member 22. Accordingly, the description of the same configuration will be omitted herein, and the shield member 22 in the second preferred embodiment will be described mainly.

As shown by two-dot and dash lines in FIGS. 2 and 3, two interfering plates 26 as an interfering member are interposed between the upper end opening 21*b* and the vent holes 25 so as to face the vent holes 25 in the shielded space 23. The interfering plates 26 are mounted on the lower surface of the top wall 22*b* of the shield member 22 so as to be circumferentially spaced from each other and to extend vertically. While the two interfering plates 26 are provided so as to respectively face the two sets of vent holes 25 in this preferred embodiment, a single cylindrical interfering member concentrical with the side wall 22*a* may be provided instead.

According to the second preferred embodiment, the following effect can be exhibited in addition to the effects similar to those of the first preferred embodiment.

Even when the fuel enters the shielded space 23 from the vent holes 25 because of causing waves in the fuel level in the float chamber 3, the fuel having entered comes into collision with the interfering plates 26 interposed between the upper end opening 21*b* of the overflow pipe 21 and the vent holes 25 so as to face the vent holes 25, so that the fuel having entered is hindered from advancing toward the upper end opening 21*b*. Thus, the fuel reaching the upper end opening 21*b* can be greatly reduced in amount, and the discharge of the fuel from the overflow pipe 21 because of waves in the fuel level can therefore be further suppressed.

Figure 4:
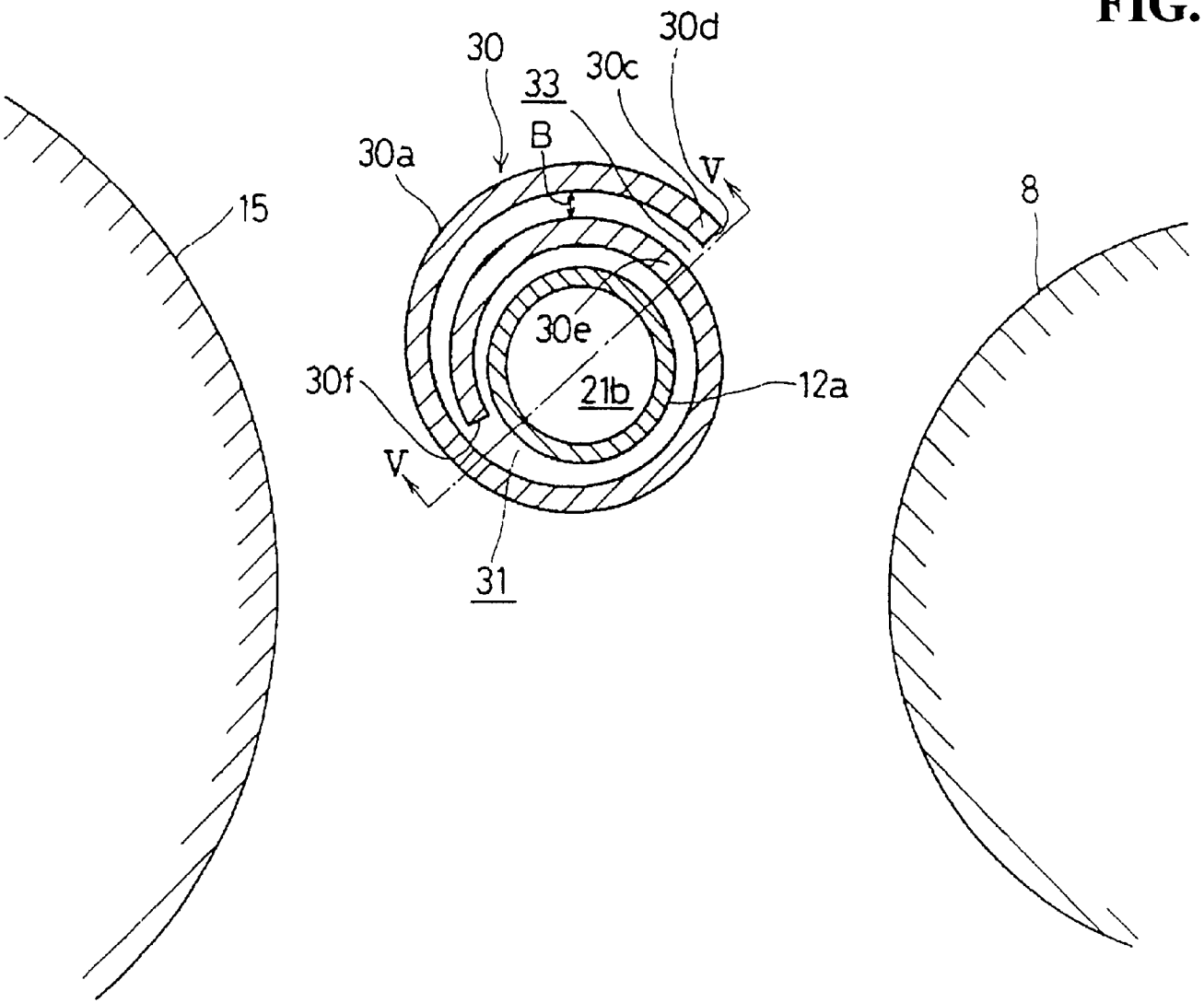
FIG. 4 is a cross section similar to FIG. 2, showing an overflow device according to a third preferred embodiment of the present invention.
Figure 5:
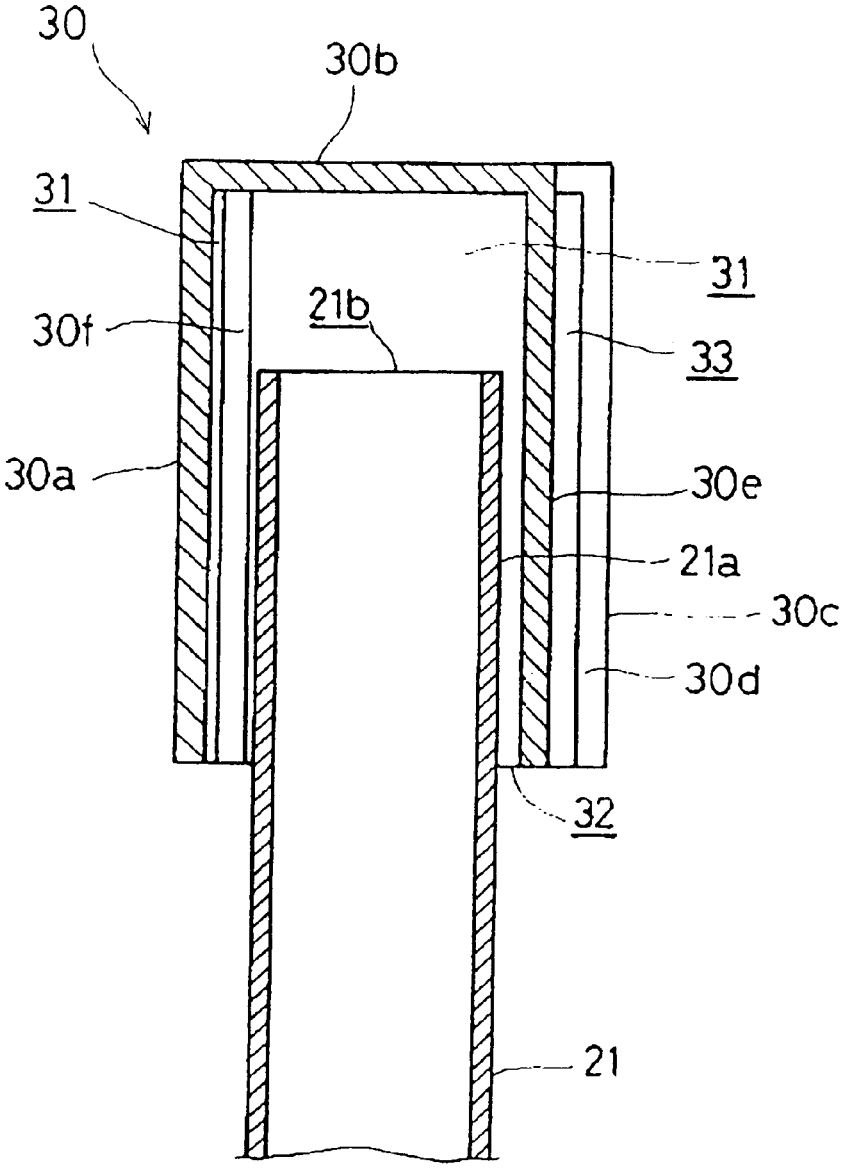
FIG. 5 is a cross section taken along the line V—V in FIG. 4.

A third preferred embodiment of the present invention will now be described with reference to FIGS. 4 and 5. The third preferred embodiment has the same configuration as that of the first preferred embodiment except for a shield member 30. Accordingly, the description of the same configuration will be omitted herein and the shield member 30 in the third preferred embodiment will be described mainly.

Like the shield member 22 in the first preferred embodiment, the shield member 30 is provided above the constant fuel level A in the float chamber 3. The shield member 30 is composed of a spiral side wall 30*a* and a top wall 30*b* contiguous to the side wall 30*a*. The top wall 30*b* is mounted on the carburetor body 2 by suitable fixing means, and has no holes. The upper end opening 21*b* of the overflow pipe 21 is positioned centrally of the spiral side wall 30*a*. Like the first preferred embodiment, the side wall 30*a* is spaced from the upper end portion 21*a* of the overflow pipe 21 in the sideward direction and vertically extends above and below the upper end opening 21*b* of the overflow pipe 21, thereby defining a spiral shielded space 31 around the upper end opening 21*b*.

The shield member 30 has a spiral fuel opening 32 defined by the lower end of the spiral side wall 30*a* for allowing the fuel in the float chamber 3 to flow into the shielded space 31 in the case of overflowing and also allowing the fuel in the shielded space 31 to flow out of the shielded space 31. The shield member 30 further has a vertically extending vent hole 33 defined by a vertically extending outer end 30*d* of an outermost side wall portion 30*c* positioned radially outermost of the side wall 30*a* and by an inner side wall portion 30*e* positioned radially inside of the outermost side wall portion 30*e* in the same radial direction as that of the outer end 30*d*.

Accordingly, a part of the vent opening 33 is positioned above the upper end opening 21*b*, and the remaining part of the vent opening 33 is positioned below the upper end opening 21*b*. Further, the vent opening 33 is opposed to the projecting portion 8 located in the vicinity of the vent opening 33. While a vertically extending inner end 30*f* of an innermost side wall portion positioned radially innermost of the side wall 30*a* is radially spaced from the overflow pipe 21 in this preferred embodiment, the inner end 30*f* may be located in contact with the overflow pipe 21.

The width B of the spiral shielded space 31 is set as small as possible so as to obtain a fuel flow through the fuel opening 32 to such a extent that the rising speed of the fuel level inside the shielded space 31 in the case of overflowing is made substantially equal to that of the fuel level outside the shielded space 31 in cooperation with the vent opening 33 and so as to suppress the entry of the fuel from the vent opening 33 into the shielded space 31 due to causing waves in the fuel in the float chamber 3.

The operation of the third preferred embodiment mentioned above will now be described.

The shield member 30 mounted on the carburetor body 2 and positioned above the constant fuel level A in the float chamber 3 has the side wall 30*a* vertically extending above and below the upper end opening 21*b* of the overflow pipe 21 to define the shielded space 31 around the upper end opening 21*b*. Thus, the overflow device composed of the overflow pipe 21 and the shield member 30 can be configured without any movable portions, i.e., with a simple structure at a low cost. Furthermore, the shield member 30 can be simply applied to any existing overflow pipes. Additionally, the shield member 30 has a reduced radial size and can be made compact, so that the degree of freedom of arrangement of the shield member 30 can be increased.

Further, even when the fuel in the float chamber 3 causes waves, the entry of the fuel from the vent opening 33 extending above and below the upper end opening 21*b* of the overflow pipe 21 into the shielded space 31 can be suppressed, and the discharge of the fuel from the upper end opening 21*b* can further be reduced owing to the presence of the shielded space 31. As a result, undue emission of the fuel through the overflow pipe 21 to the outside of the float chamber 3 can be suppressed.

Further, since a part of the vent opening 33 is positioned above the upper end opening 21*b*, an effect similar to that of the first preferred embodiment can be exhibited with regard to the rise of the fuel level in the shielded space 31 in the case of overflowing.

The vent opening 33 can be formed at a circumferentially arbitrary position on the side wall 30*a* of the shield member 30. That is, the degree of freedom of arrangement of the vent opening 33 is large. Accordingly, by arranging the vent opening 33 at the position opposed to the projecting portion 8 formed in the vicinity of the side wall 30*a* in the float chamber 3, the waving fuel in the float chamber 3 is difficult to enter the shielded space 31 through the vent opening 33. As a result, undue emission of the fuel through the overflow pipe 21 to the outside of the float chamber 3 can be further suppressed.

Even when the fuel enters the shielded space 31 from the vent opening 33, most of the fuel having entered comes into collision with the inner wall surface of the outermost side wall portion 30*c* and the outer wall surface of the inner side wall portion 30*e*, and is therefore hindered from advancing toward the upper end opening 21*b* of the overflow pipe 21. Accordingly, the fuel reaching the upper end opening 21*b* can be greatly reduced in amount, and the discharge of the fuel from the overflow pipe 21 because of causing waves in the fuel level can therefore be further suppressed.

Figure 6:
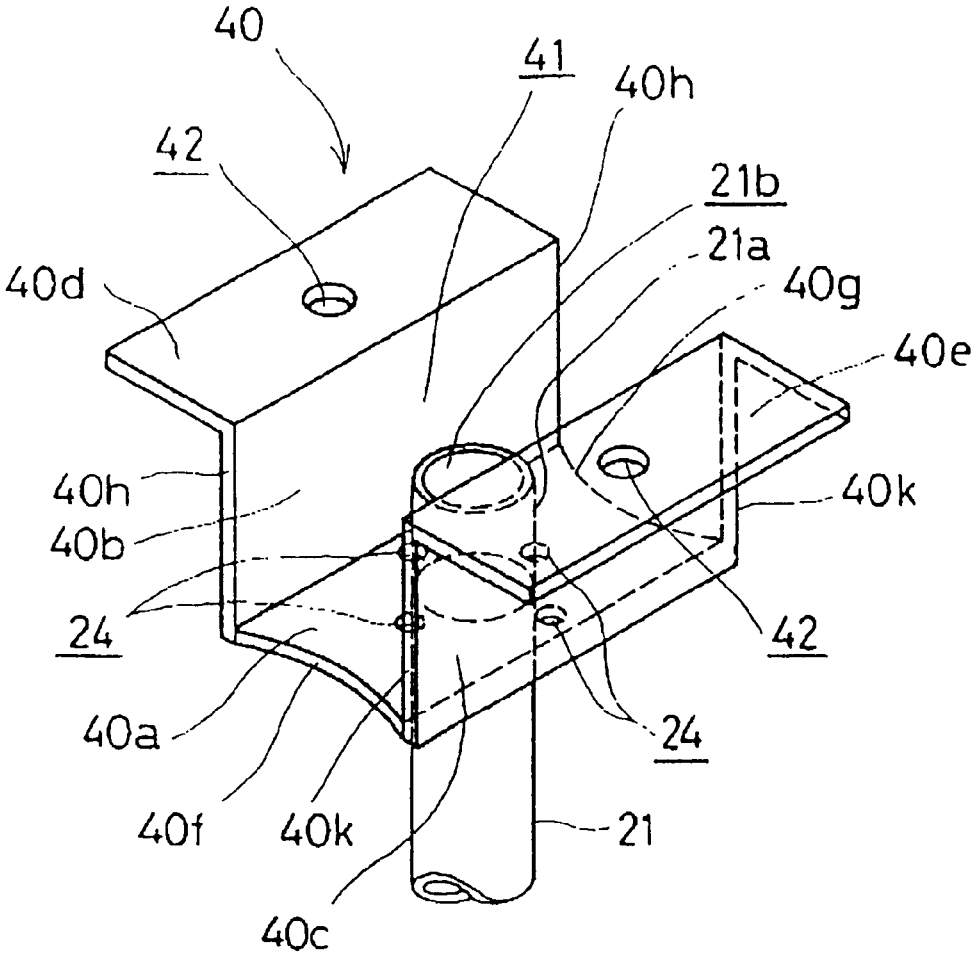
FIG. 6 is a perspective view of an essential part of an overflow device according to a fourth preferred embodiment of the present invention.
Figure 7:
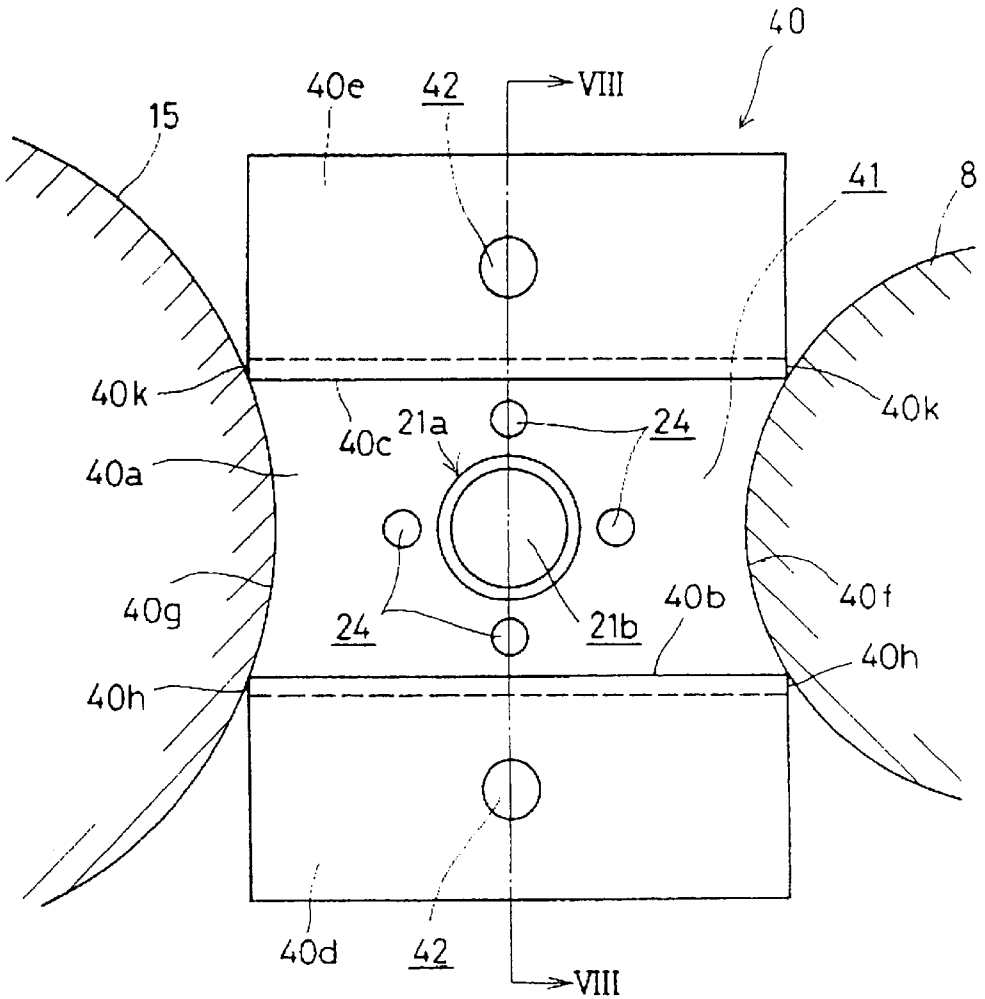
FIG. 7 is a top plan view of the overflow device according to the fourth preferred embodiment.
Figure 8:
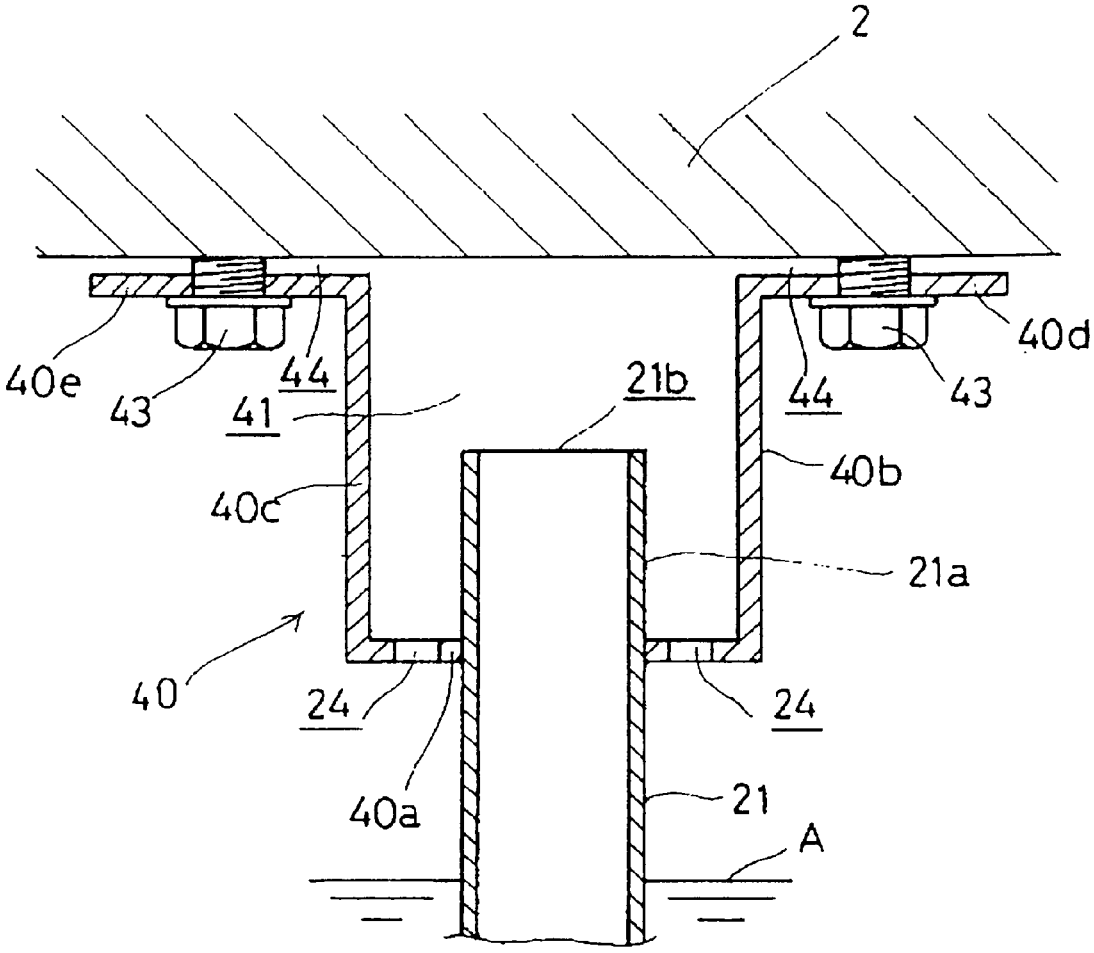
FIG. 8 is a cross section taken along the line VIII—VIII in FIG. 7.

A fourth preferred embodiment of the present invention will now be described with reference to FIGS. 6 to 8. The fourth preferred embodiment has the same configuration as that of the first preferred embodiment except for a shield member 40 and the arrangement of the overflow pipe 21. Accordingly, the description of the same configuration will be omitted or simplified herein, and the shield member 40 and the arrangement of the overflow pipe 21 in the fourth preferred embodiment will be described mainly.

The overflow pipe 21 is arranged at a substantially central position on a shortest straight line connecting the projecting portions 8 and 15 in the float chamber 3. The shield member 40 is positioned above the constant fuel level A and interposed between the projecting portions 8 and 15 in contact therewith. The shield member 40 is formed by bending a substantially rectangular plate so as to form a central recess, thereby defining a shielded space 41 shielded from the space 3*a* in the float chamber 3 around the upper end opening 21*b* of the overflow pipe 21 in cooperation with the projecting portions 8 and 15 and the carburetor body 2.

More specifically, the shield member 40 is composed of a flat bottom wall 40*a*, a pair of flat side walls 40*b* and 40*c* extending vertically upward from the opposite sides of the bottom wall 40*a* so as to be opposed to each other, and a pair of flat mounting walls 40*d* and 40*e* extending horizontally from the upper ends of the side walls 40*b* and 40*c*, respectively, in opposite directions in substantially parallel relationship with the bottom wall 40*a*. The bottom wall 40*a* is spaced from the upper end opening 21*b* in the downward direction and has an insert hole having a diameter substantially equal to the outer diameter of the overflow pipe 21. The insert hole is formed at a substantially central portion of the bottom wall 40*a*, and the overflow pipe 21 is fitted with the insert hole of the bottom wall 40*a*. The opposite ends of the bottom wall 40*a* between the side walls 40*b* and 40*c* are formed as a pair of concave portions 40*f* and 40*g* arranged in contact with the outer circumferences of the projecting portions 8 and 15, respectively.

The side walls 40*b* and 40*c* are spaced from the upper end portion 21*a* of the overflow pipe 21 in the sideward direction, and extend above and below the upper end opening 21*b* of the overflow pipe 21. The side wall 40*b* has a pair of vertically extending opposite ends 40*h* arranged in contact with the outer circumferences of the projecting portions 8 and 15. Similarly, the side wall 40*c* has a pair of vertically extending opposite ends 40*k* arranged in contact with the outer circumferences of the projecting portions 8 and 15. Further, the mounting walls 40*d* and 40*e* are spaced from the upper end opening 21*b* in the upward direction. Each of the mounting walls 40*d* and 40*e* is formed with a mounting hole 42, and a bolt 43 is inserted through each mounting hole 42 and threadedly engaged with the carburetor body 2 so as to define vent gaps 44 (which will be hereinafter described) between the mounting walls 40*d* and 40*e* and the carburetor body 2. Thus, the shield member 40 is mounted to the carburetor body 2 by the bolts 43.

Like the first preferred embodiment, the bottom wall 40*a* is formed with a plurality of (e.g., four) fuel holes 24 as a fuel opening positioned only below the upper end opening 21*b*. The four fuel holes 24 are spaced from each other around the insert hole in which the overflow pipe 21 is inserted. A pair of vent gaps 44 as a vent opening for making communication between the space 3*a* and the shielded space 41 are defined between the mounting walls 40*d* and 40*e* and the carburetor body 2. The vent gaps 44 are positioned above and to each side of the upper end opening 21*b*. The vent gaps 44 are gaps defined between the mounting walls 40*d* and 40*e* and the carburetor body 2 by first inserting the shield member 40 between the projecting portions 8 and 15 from their lower ends in the condition where the concave portions 40*f* and 40*g* of the bottom wall 40*a* are respectively opposed to the outer circumferences of the projecting portions 8 and 15, and next mounting the shield member 40 to the carburetor body 2 by means of the bolts 43 inserted through the mounting holes 42 of the mounting walls 40*d* and 40*e*. That is, the vent gaps 44 are defined above the mounting walls

40*d* and 40*e* extending like flanges in substantially parallel to the constant fuel level A.

The vent gaps 44 have a function similar to the function of the vent holes 25 in the first preferred embodiment, and the size of each vent gap 44 is set so as not to hinder a smooth rise of the fuel level in the shielded space 41 by the fuel flowing through the fuel holes 24 into the shielded space 41 in the case of overflowing and so as to suppress the entry of the fuel from the vent gaps 44 due to waves in the fuel in the float chamber 3. In setting the size of each vent gap 44, spacers each having a given thickness may be interposed between the mounting walls 40*d* and 40*e* and the carburetor body 2 in such a manner that the bolt 43 is inserted through a hole formed in each spacer.

Thus, the shield member 40 is arranged between the projecting portions 8 and 15 in such a manner that the concave portions 40*f* and 40*g* of the bottom wall 40*a* of the shield member 40 and the opposite ends 40*h* and 40*k* of the side walls 40*b* and 40*c* of the shield member 40 come into contact with the outer circumferences of the projecting portions 8 and 15 as a part of the carburetor body 2, and that the mounting walls 40*d* and 40*e* of the shield member 40 are opposed to the carburetor body 2 with the vent gaps 44 defined therebetween. With this arrangement, the shielded space 41 is defined by the shield member 40 and the carburetor body 2 including the projecting portions 8 and 15 as a part thereof. Accordingly, when the fuel in the float chamber 3 has the constant fuel level A, the overflow pipe 21 is always kept in communication with the space 3*a* in the float chamber 3 through the shielded space 41 by only the fuel holes 24 and the vent gaps 44 (any possible very small gaps such as a very small gap possibly produced between the insert hole of the bottom wall 40*a* and the overflow pipe 21 fitted with the insert hole and very small gaps possibly produced between the shield member 40 and the outer circumferences of the projecting portions 8 and 15 may be considered to be negligible). On the other hand, in the case of overflowing, the fuel in the float chamber 3 can be discharged from the float chamber 3 through the shielded space 41.

The fourth preferred embodiment can exhibit effects similar to those of the first preferred embodiment in the points that the overflow device can be produced with a simple structure at a low cost, that the entry of the fuel from the vent gaps 44 positioned above the upper end opening 21*b* can be suppressed and undue emission of the fuel can be suppressed by the presence of the shielded space 41, and that excess fuel at the preset overflow level can be discharged. The fourth preferred embodiment can exhibit the following additional effects.

The shielded space 41 is defined not only by the shield member 40 arranged between the projecting portions 8 and 15, but also by the carburetor body 2 including the projecting portions 8 and 15, by arranging the concave portions 40*f* and 40*g* of the bottom wall 40*a* of the shield member 40 and the opposite ends 40*h* and 40*k* of the side walls 40*b* and 40*c* of the shield member 40 in contact with the outer circumferences of the projecting portions 8 and 15, and arranging the mounting walls 40*d* and 40*e* of the shield member 40 in opposition to the carburetor body 2 with the vent gaps 44 defined therebetween. That is, the shield member 40 itself can be easily formed by bending a substantially rectangular plate in order to define the shielded space 41. Therefore, the cost can be further reduced.

The size of each vent gap 44 is set so as to suppress the entry of the fuel from the vent gaps 44 into the shielded space 41 due to causing waves in the fuel in the float chamber 3. Furthermore, the vent gaps 44 are defined above the horizontal mounting walls 40*d* and 40*e* extending like flanges substantially parallel to the constant fuel level A. Accordingly, the entry of the fuel from the vent gaps 44 due to causing waves in the fuel level A positioned below the shield member 40 can be further suppressed.

Some modifications of the above preferred embodiments will now be described.

While the vent opening in each of the first and second preferred embodiments is provided by the vent holes 25, the vent opening in the present invention may be provided by at least one slit formed through the side wall 22*a* and vertically extending between an upper position above the upper end opening 21*b* and a lower position below the upper end opening 21*b*. In this case, the slit has a small width to such an extent that the entry of the fuel from the slit into the shielded space 23 can be suppressed. With this arrangement, a part of the slit is positioned above the upper end opening 21*b*, and the remaining part of the slit is positioned below the upper end opening 21*b*.

While the shield member 22 in each of the first and second preferred embodiments is composed of the top wall 22*b*, the side wall 22*a*, and the bottom wall 22*c*, the shield member in the present invention may be composed of only a side wall having a vent opening. In this case, the shield member may be mounted to the carburetor body 2 so that the upper end of the shield member comes into contact with the carburetor body 2 and that the horizontal space between the shield member and the upper end portion 21*a* of the overflow pipe 21 is set to a narrow space to such an extent that the entry of the fuel through this space into the shielded space 23 in the case of overflowing is not hindered. Alternatively, the shield member in the present invention may be composed of only a side wall having no vent opening. In this case, the shield member may be mounted to the carburetor body 2 so as to define a gap therebetween having a size such that the entry of the fuel through this gap into the shielded space 23 due to causing waves in the fuel in the float chamber 3 can be suppressed. This gap defined between the shield member and the carburetor body 2 serves as a vent opening. In this case, the mounting of the shield member to the carburetor body 2 may be effected through mounting projections formed on the circumferential edge of the upper end of the side wall and circumferentially spaced from each other.

While the four fuel holes 24 and the four vent holes 25 are formed in each of the first and second preferred embodiments, the numbers of the fuel holes 24 and the vent holes 25 are not limitative, but it is sufficient to form at least one fuel opening and at least one vent opening.

While the shield member 22 in each of the first and second preferred embodiments has a cylindrical shape having a circular cross section, the shield member in the present invention may have a cylindrical shape having a rectangular cross section.

While the shield member 30 in the third preferred embodiment is composed of the side wall 30*a* and the top wall 30*b*, the top wall 30*b* may be omitted.

While the shield member 22 or 30 in each of the first to third preferred embodiments is mounted on the carburetor body 2, the shield member 22 or 30 may be mounted on the overflow pipe 21.

The vent holes 25 and the vent opening 33 may be formed at any arbitrary positions other than the positions specified in the above preferred embodiments as required.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. In a carburetor having a float chamber and a float provided in said float chamber wherein the amount of fuel flowing into said float chamber is adjusted according to behavior of said float to thereby form a constant fuel level in said float chamber; an overflow device comprising:

an overflow pipe having an upper end opening exposed to a space in said float chamber defined above said constant fuel level; and a shield member arranged above said constant fuel level and having a side wall extending along an upper end portion of said overflow pipe between an upper position above said upper end opening and a lower position below said upper end opening so as to define a shielded space around said upper end opening;

said shielded space being kept in communication with said space in said float chamber through a fuel opening for allowing the fuel to flow into and out of said shielded space and a vent opening capable of suppressing the entry of the fuel into said shielded space;

said fuel opening being positioned below said upper end opening; and at least a part of said vent opening being positioned above said upper end opening.

2. The overflow device according to claim 1, wherein:

said shield member further has a top wall positioned above said upper end opening and a bottom wall positioned below said upper end opening, said top wall and said bottom wall being contiguous to said side wall;

said fuel opening is a hole formed through said bottom wall; and said vent opening is a hole formed through said side wall.

3. The overflow device according to claim 2, and further including an interfering member provided in said shielded space between said upper end opening and said vent opening in opposed relationship with said vent opening.

4. The overflow device according to claim 3, wherein said interfering member is a plate disposed adjacent to said vent openings for retarding the flow of fuel through the vent openings.

5. The overflow device according to claim 1, and further including an interfering member provided in said shielded space between said upper end opening and said vent opening in opposed relationship with said vent opening.

6. The overflow device according to claim 5, wherein said interfering member is a plate disposed adjacent to said vent openings for retarding the flow of fuel through the vent openings.

7. The overflow device according to claim 1, wherein:

said side wall is provided spirally about said upper end opening so as to extend along said upper end portion of said overflow pipe; and said vent opening is formed by an outer end of an outermost side wall portion positioned radially outermost of said side wall and an inner side wall portion positioned radially inside of said outermost side wall portion.

8. The overflow device according to claim 7, wherein said fuel opening is formed in an open bottom portion of the spiral side wall.

9. The overflow device according to claim 1, wherein the shield member has a substantially U-shape with an open top portion, a bottom, two open side walls and two closed side walls, said fuel opening being formed in said bottom and said vent opening being formed by an opening formed adjacent to the open top portion of said shield member.

10. The overflow device according to claim 1, wherein a plurality of fuel openings are formed in a lower portion of said shield member for permitting ingress and egress of fuel to said shielded space.

11. In a carburetor having a float chamber and a float provided in said float chamber wherein the amount of fuel flowing into said float chamber is adjusted according to behavior of said float to thereby form a constant fuel level in said float chamber; an overflow device comprising:

an overflow pipe having an upper end opening exposed to a space in said float chamber defined above said constant fuel level;

a shield member arranged adjacent to said constant fuel level and having a side wall extending along an upper end portion of said overflow pipe between an upper position above said upper end opening and a lower position below said upper end opening for defining a shielded space around said upper end opening;

a fuel opening formed in said shield member for permitting fuel to flow into and out of said shielded space, said fuel opening being positioned below said upper end opening; and a vent opening for suppressing the entry of the fuel into said shielded space, at least a part of said vent opening being positioned above said upper end opening.

12. The overflow device according to claim 11, wherein:

said shield member further includes a top wall positioned above said upper end opening and a bottom wall positioned below said upper end opening, said top wall and said bottom wall being contiguous to said side wall;

a hole formed through said bottom wall for forming said fuel opening; and a hole formed through said side wall for forming said vent opening.

13. The overflow device according to claim 12, and further including an interfering member provided in said shielded space between said upper end opening and said vent opening in opposed relationship with said vent opening.

14. The overflow device according to claim 13, wherein said interfering member is a plate disposed adjacent to said vent openings for retarding the flow of fuel through the vent openings.

15. The overflow device according to claim 11, and further including an interfering member provided in said shielded space between said upper end opening and said vent opening in opposed relationship with said vent opening.

16. The overflow device according to claim 15, wherein said interfering member is a plate disposed adjacent to said vent openings for retarding the flow of fuel through the vent openings.

17. The overflow device according to claim 11, wherein:

said side wall is provided spirally about said upper end opening so as to extend along said upper end portion of said overflow pipe; and said vent opening is formed by an outer end of an outermost side wall portion positioned radially outermost of said side wall and an inner side wall portion positioned radially inside of said outermost side wall portion.

18. The overflow device according to claim 17, wherein said fuel opening is formed in an open bottom portion of the spiral side wall.

19. The overflow device according to claim 11, wherein the shield member has a substantially U-shape with an open top portion, a bottom, two open side walls and two closed side walls, said fuel opening being formed in said bottom and said open sides and said vent opening being formed by an opening formed adjacent to the open top portion of said shield member.

20. The overflow device according to claim 11, wherein a plurality of fuel openings are formed in a lower portion of said shield member for permitting ingress and egress of fuel to said shielded space.

* * * * *